US005730313A

United States Patent [19]

Hayes et al.

[11] Patent Number: 5,730,313

[45] Date of Patent: Mar. 24, 1998

[54] SPLASH-RESISTANT FOOD CONTAINER

[75] Inventors: Thomas J. Hayes, Wauconda; Michael J. A. Sagan, Batavia; James N. Gomoll, Chicago, all of Ill.

[73] Assignee: Tenneco Packaging Inc., Evanston, Ill.

[21] Appl. No.: 718,944

[22] Filed: Sep. 24, 1996

[51] Int. Cl.[6] ..... B65D 21/02

[52] U.S. Cl. ..... 220/526

[58] Field of Search ..... 220/526, 306

[56] References Cited

U.S. PATENT DOCUMENTS

| | | | |
|---|---|---|---|
| 3,487,972 | 1/1970 | Swett | 220/526 |
| 3,595,425 | 7/1971 | Eicholtz et al. | 220/526 |
| 5,027,972 | 7/1991 | Bartholomew | 220/526 |

OTHER PUBLICATIONS

Brochure "Micro Fine" by Central Fine Pack of Fort Wayne, Indiana; Jan., 1993.

Pamphlet entitled "Classic Carry–Out Containers" by PCA Specialty Packaging Group of Northbrook, IL; Mar., 1995.

Pamphlet entitled "Classic Carry–Out Meal Delivery System—An Extraordinary New Way to Carry Meals Out" by PCA Specialty Packaging Group of Northbrook, IL, Oct., 1994.

Pamphlet entitled "Classic Carry–Out Containers—Where White Cloth Dining Meets Carry–Out Convenience" by PCA Specialty Packaging Group of Northbrook, IL; Mar., 1995.

Tenneco Packaging Specialty Products Catalog, Summer of 1996.

Photographs of Central Fine Pack Container, Central Fine Pack, Inc. of Fort Wayne, Indiana no date.

#9842 Container Drawing; Ecko Products, Inc. of Wheeling, Illinois; Dec. 18, 1985.

#9282 Dome Drawing; Ecko Products, Inc. of Wheeling, Illinois; Jan. 10, 1986.

#9843 Container Drawing; Ecko Products, Inc. of Wheeling, Illinois; Dec. 19, 1985.

*Primary Examiner*—Jes F. Pascua

*Attorney, Agent, or Firm*—Arnold, White & Durkee

[57] ABSTRACT

A plastic food container includes a lid and a base. The lid includes a continuous first body portion and a continuous first rim encompassing and projecting laterally outwardly from the first body portion. The first body portion includes at least one lid partition dividing the first body portion into at least two lid compartments. The lid partition includes, in cross-section, a generally inverted trough-shaped female partition member. The first rim includes, in cross-section, a generally inverted trough-shaped female peripheral member. The base includes a continuous second body portion and a continuous second rim encompassing and projecting laterally outwardly from the second body portion. Like the first body portion of the lid, the second body portion includes at least one base partition dividing the second body portion into at least two base compartments. The base partition includes, in cross-section, a generally inverted trough-shaped male partition member. The second rim includes, in cross-section, a generally inverted trough-shaped male peripheral member. When the lid is connected to the base, the male and female partition members are engaged to each other to form an intercompartmental splash guard that minimizes passage of food juices between the base compartments. Also, the male and female peripheral members are latched to each other to both hold the lid and base together and form a peripheral splash guard that minimizes escape of food juices from the periphery of the container.

11 Claims, 9 Drawing Sheets

14

SPLASH-RESISTANT FOOD CONTAINER

FIELD OF THE INVENTION

The present invention relates generally to plastic food containers and, more particularly, relates to a multi-compartment plastic food container having an intercompartmental splash guard for minimizing passage of food juices between compartments of the container and a peripheral splash guard for minimizing escape of food juices from the periphery of the container.

BACKGROUND OF THE INVENTION

A multi-compartment plastic food container is typically used to hold different food items in separate compartments of the container. In such a multi-compartment container, it is desirable to retain the food items in their respective compartments so that a food item in one compartment does not commingle with a food item in another compartment. Undesirable mixing of food items can corrupt the flavor and consistency of the food items. A drawback of many existing multi-compartment containers is that they allow food items, especially food juices, to pass between compartments.

Another drawback of such containers is that they allow leakage of food juices from the periphery thereof. By way of explanation, a container typically includes a lid having a first peripheral rim and a base having a second peripheral rim. Food juices have a tendency to escape from the container through small gaps between the first and second peripheral rims.

A need therefore exists for a multi-compartment plastic food container that substantially overcomes the aforementioned shortcomings associated with many existing multi-compartment containers.

SUMMARY OF THE INVENTION

A plastic food container includes a lid and a base. The lid includes a continuous first body portion and a continuous first rim encompassing and projecting laterally outwardly from the first body portion. The first body portion includes at least one lid partition dividing the first body portion into at least two lid compartments. The lid partition includes, in cross-section, a generally inverted trough-shaped female partition member. The first rim includes, in cross-section, a generally inverted trough-shaped female peripheral member.

The base includes a continuous second body portion and a continuous second rim encompassing and projecting laterally outwardly from the second body portion. Like the first body portion of the lid, the second body portion includes at least one base partition dividing the second body portion into at least two base compartments. The base partition includes, in cross-section, a generally inverted trough-shaped male partition member. The second rim includes, in cross-section, a generally inverted trough-shaped male peripheral member.

When the lid is connected to the base, the male and female partition members are engaged to each other to form an intercompartmental splash guard that minimizes passage of food juices between the base compartments. Also, the male and female peripheral members are latched to each other to both hold the lid and base together and form a peripheral splash guard that minimizes escape of food juices from the periphery of the container.

BRIEF DESCRIPTION OF THE DRAWINGS

Other objects and advantages of the invention will become apparent upon reading the following detailed description and upon reference to the drawings in which.

Figure 1:
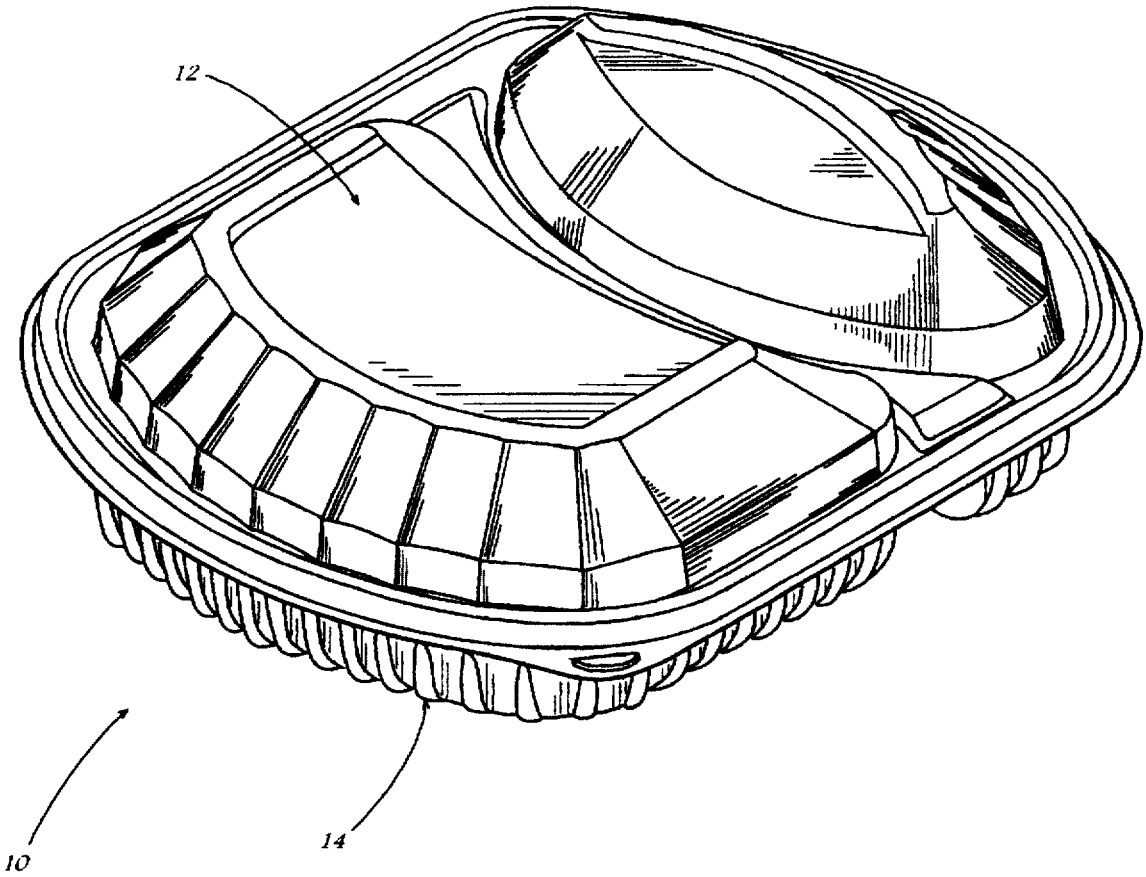
FIG. 1 is an isometric view of a multi-compartment plastic food container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to the drawings, FIG. 1 illustrates a multi-compartment plastic food container 10 embodying the present invention. The plastic food container 10 includes a lid 12 and a base 14.

Figure 2:
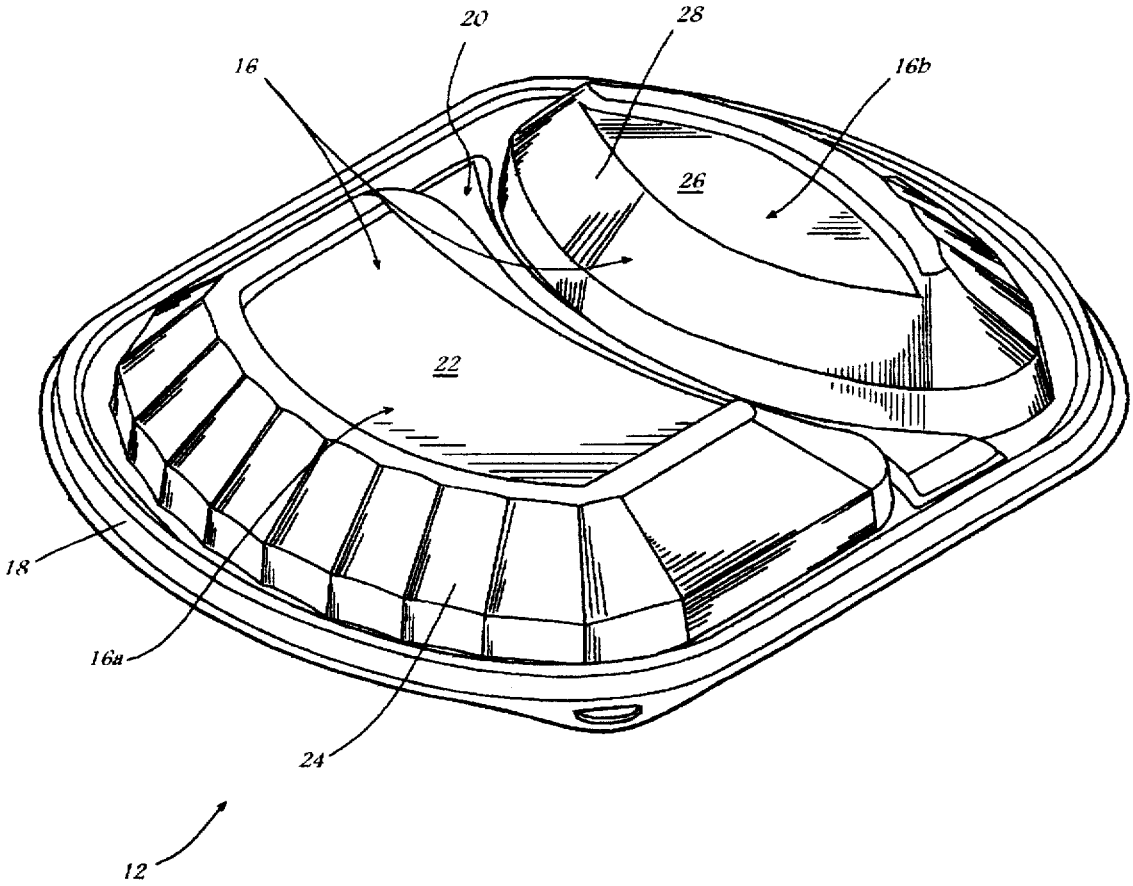
FIG. 2 is an isometric view of a lid of the food container in FIG. 1.
Figure 3:
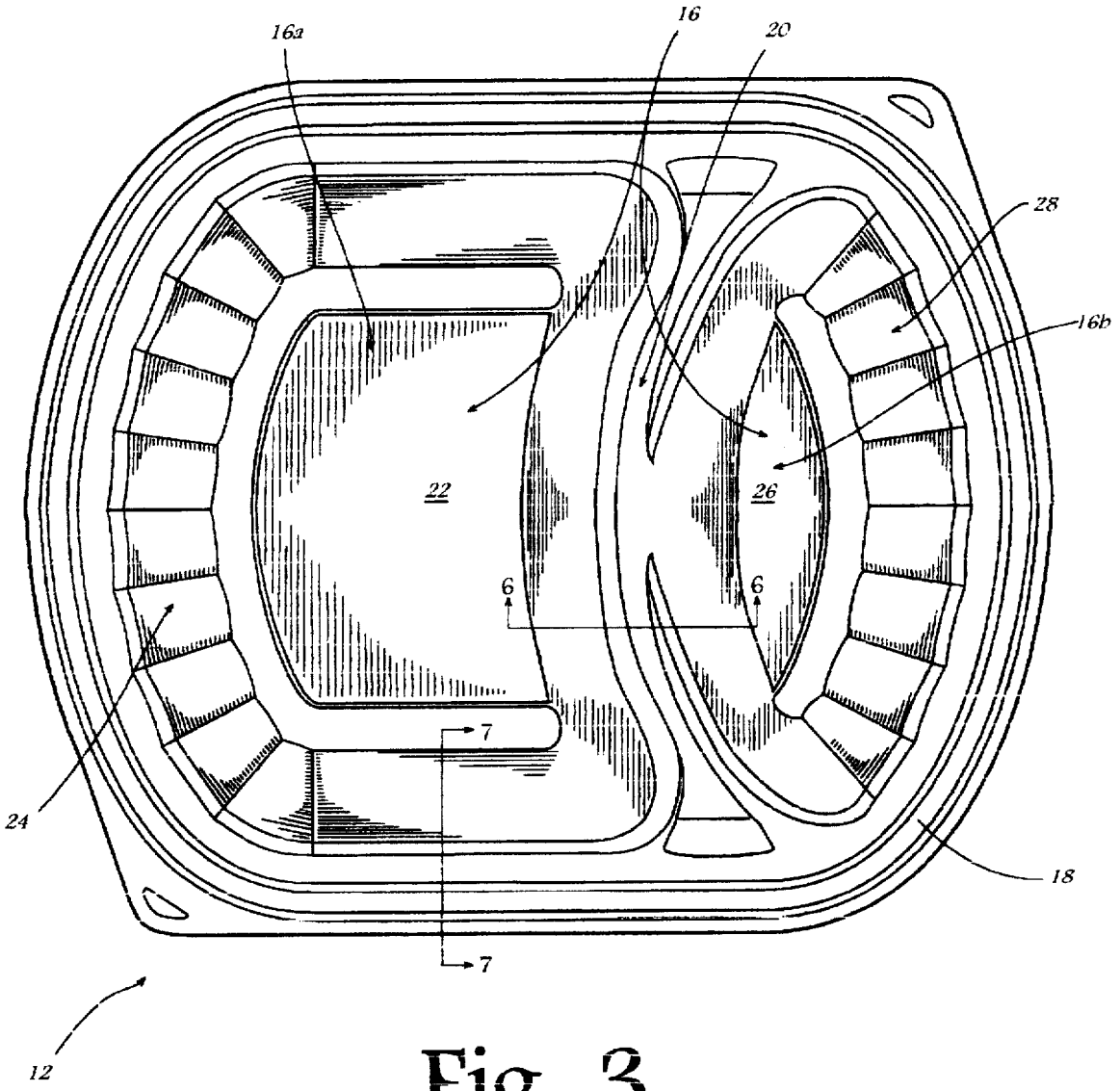
FIG. 3 is a top plan view of the lid of the food container in FIG. 1.

Referring to FIGS. 2 and 3, the lid includes a continuous first body portion 16 and a continuous first rim 18 encompassing and projecting laterally outwardly from the first body portion 16. The first body portion 16 includes at least one lid partition 20 dividing the first body portion 16 into at least two lid compartments **16*a* and 16*b*. The lid compartment 16*a* is defined by a top wall 22 and a continuous side wall 24. The continuous side wall 24 encompasses the top wall 22 and extends downwardly and outwardly from the top wall 22. Like the lid compartment 16*a*, the lid compartment 16*b* is defined by a top wall 26 and a continuous side wall 28. The continuous side wall 28 encompasses the top wall 26 and extends downwardly and outwardly from the top wall 26. The lid partition 20 includes adjacent and opposing sections of the side walls 24 and 28. Both the side wall 24 of the lid compartment 16*a* and the side wall 28 of the lid compartment 16*b* preferably include some type of ribbing structure to help provide the container 10** with top load compression strength.

Figure 4:
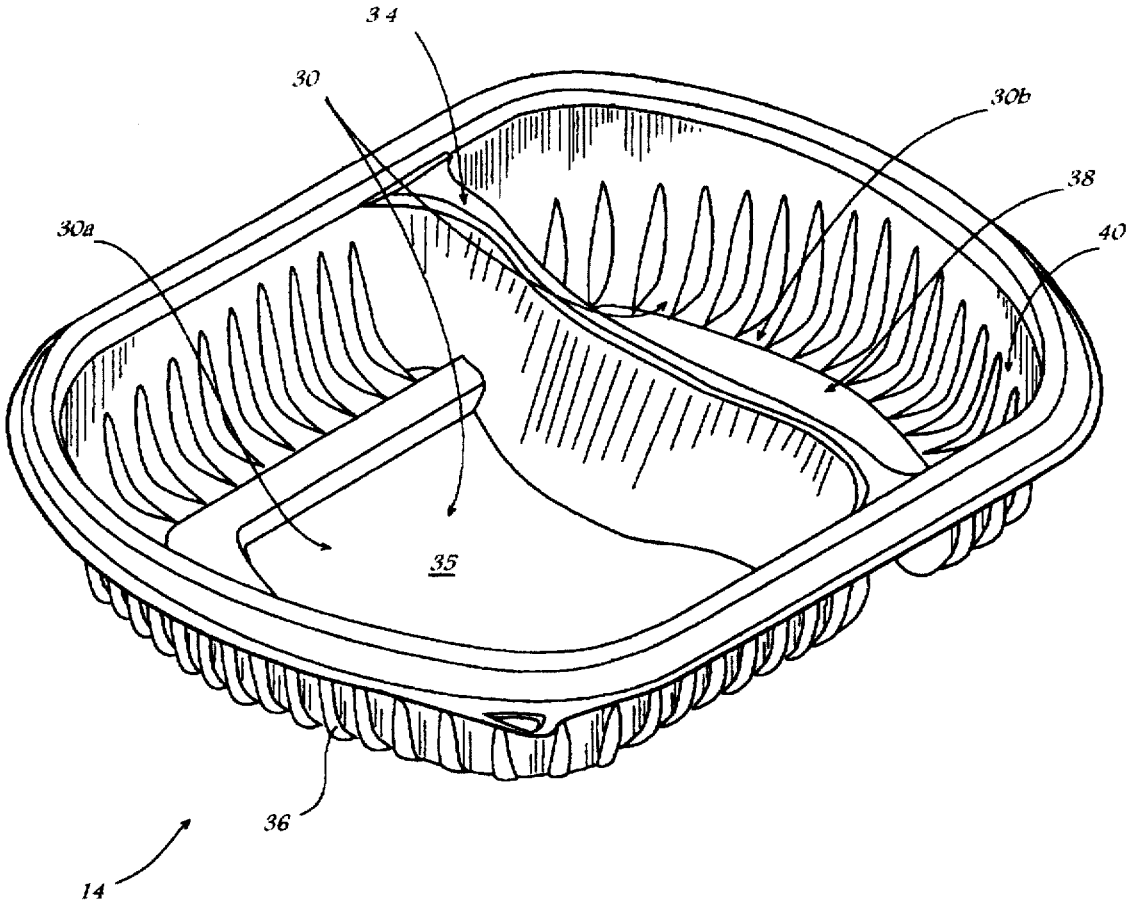
FIG. 4 is an isometric view of a base of the food container in FIG. 1.
Figure 5:
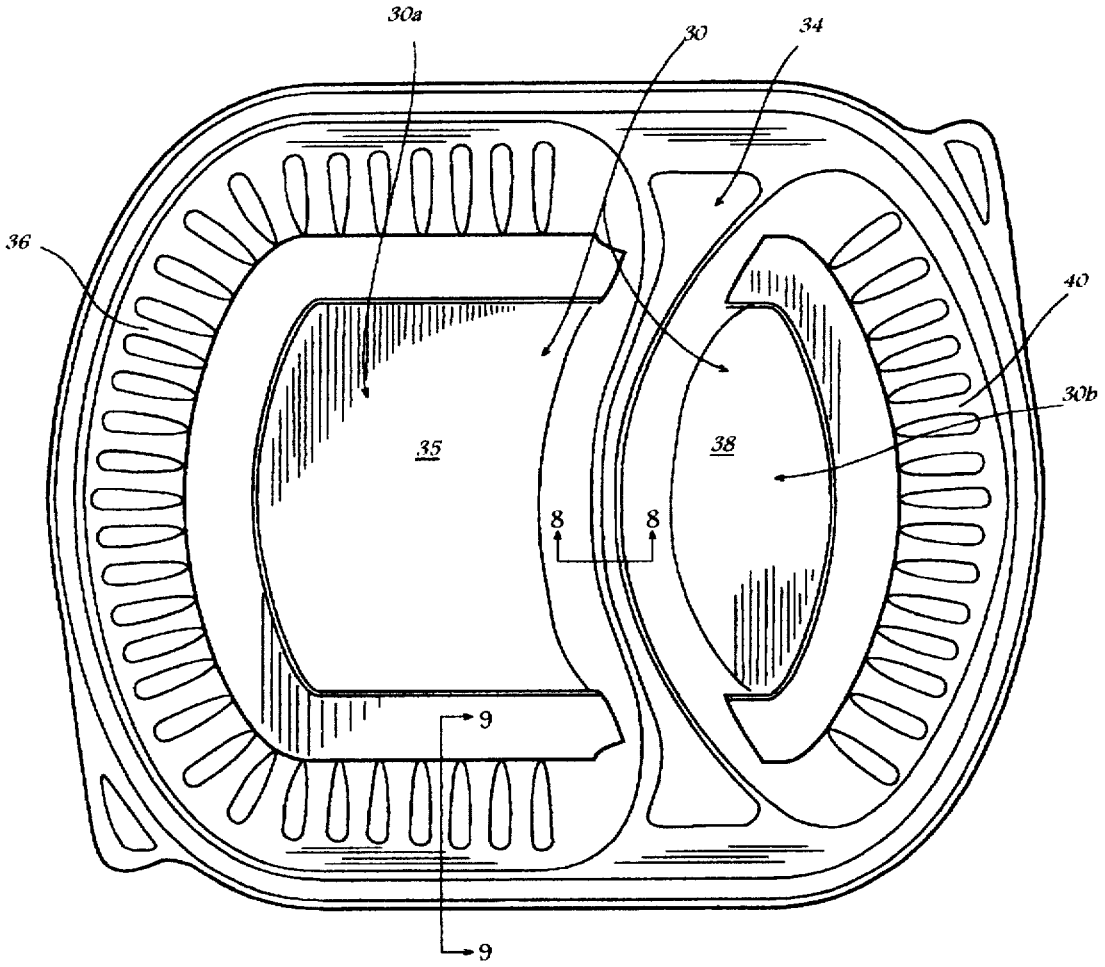
FIG. 5 is a top plan view of the base of the food container in FIG. 1.

Referring to FIGS. 4 and 5, the base 14 includes a continuous second body portion 30 and a continuous second rim 32 encompassing and projecting laterally outwardly from the second body portion 30. Like the first body portion 16 of the lid 12, the second body portion 30 includes at least one base partition 34 dividing the second body portion 30 into at least two base compartments 30*a* and 30*b*. The base compartment 30*a* is defined by a bottom wall 35 and a continuous side wall 36. The continuous side wall 36 encompasses the bottom wall 35 and extends upwardly mad outwardly from the bottom wall 35. Like the base compartment 30*a*, the base compartment 30*b* is defined by a bottom wall 38 and a continuous side wall 40. The continuous side wall 40 encompasses the bottom wall 38 and extends upwardly and outwardly from the bottom wall 38. The base partition 34 includes adjacent and opposing sections of the side walls 36 and 40. Both the side wall 36 of the base compartment 30*a* and the side wall 40 of the base compartment 30*b* preferably include some type of ribbing structure to help provide the container 10 with top load compression strength.

Figure 6:
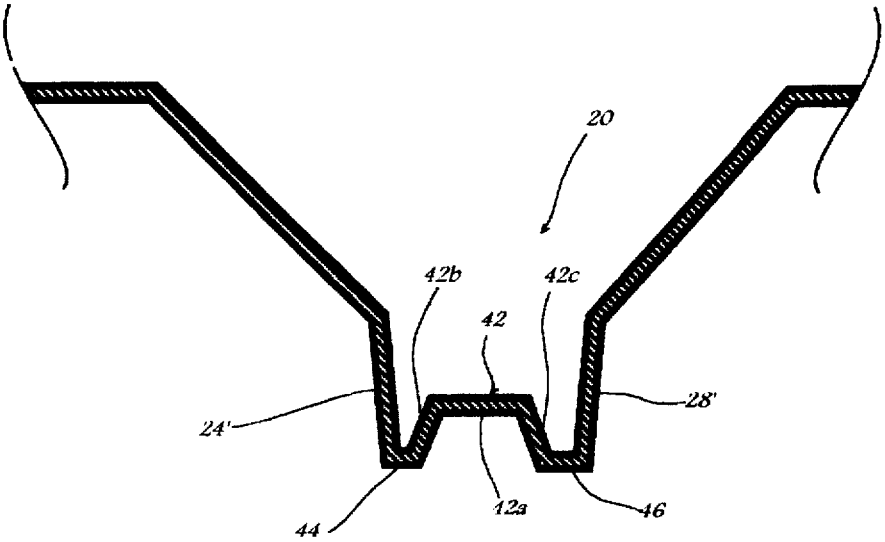
FIG. 6 is a sectional view taken generally along line 6—6 in FIG. 3.

Referring to FIG. 6, the lid partition 20 includes, in cross-section, a central female partition member 42, a pair of generally horizontal linear members 44 and 46, and side wall members 24' and 28'. The central female partition member 42 has a generally inverted trough-shaped configuration. Further, the female partition member 42 includes a generally horizontal linear member 42*a* and a pair of generally vertical linear members 42*b* and 42*c* extending downwardly and laterally away from the horizontal linear member 42*a*. The horizontal distance between the members 42*b* and 42*c* is closest at the member 42*a* and gradually increases as one moves away from the member 42*a*. The pair of small horizontal linear members 44 and 46 extend in opposite directions from the central female partition member 42. The side wall member 24' extends upwardly and laterally away from the generally horizontal linear member 44, while the side wall member 28' extends upwardly and laterally away from the generally horizontal linear member 46.

Figure 7:
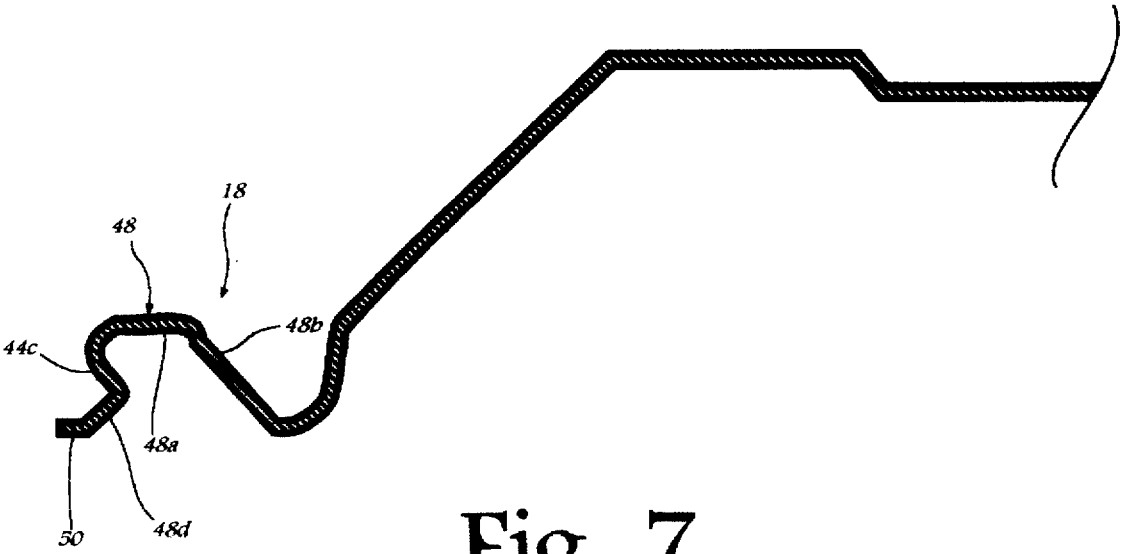
FIG. 7 is a sectional view taken generally along line 7—7 in FIG. 3.

Referring to FIG. 7, the first rim 18 includes, in cross-section, a female peripheral member 48 and a generally horizontal flange 50 projecting laterally outwardly from the female peripheral member 48. The female peripheral member 48 has a generally inverted trough-shaped configuration. Further, the female peripheral member 48 includes a generally horizontal linear member 48*a*, a first pair of members 48*b* and 48*c* , and a linear member 48*d*. The generally linear member 48*b* extends downwardly and laterally away from the generally horizontal linear member 48*a*. The member 48*c* extends downwardly from and laterally toward the generally horizontal linear member 48*a*. The linear member 48*d* extends downwardly and laterally away from the member 48*c* and intersects the horizontal flange 50.

Figure 8:
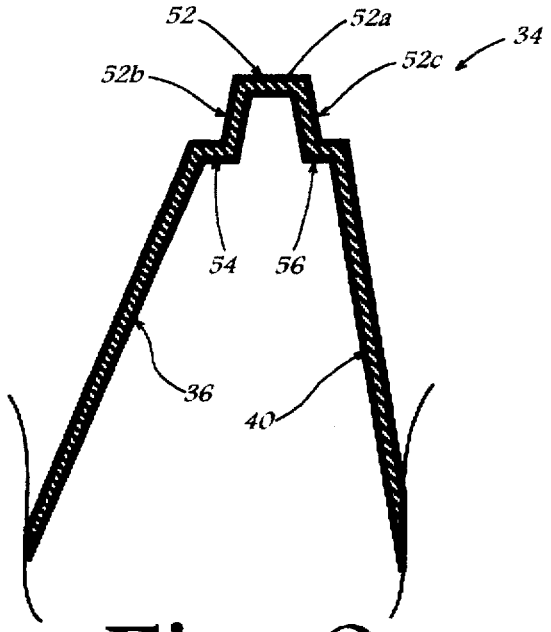
FIG. 8 is a sectional view taken generally along line 8—8 in FIG. 5.

Referring to FIG. 8, the base partition 34 includes, in cross-section, a central male partition member 52, a pair of generally horizontal linear members 54 and 56, and side wall members 36' and 40'. The central male partition member 52 has a generally inverted trough-shaped configuration. Further, the male partition member 52 includes a generally horizontal linear member 52*a* and a pair of generally vertical linear members 52*b* and 52*c* extending downwardly and laterally away from the horizontal linear member 52*a*. The horizontal distance between the members 52*b* and 52*c* is closest at the member 52*a* and gradually increases as one moves away from the member 52*a*. The pair of small horizontal linear members 54 and 56 extend in opposite directions from the central male partition member 52. The side wall member 36' extends downwardly and laterally away from the generally horizontal linear member 54, while the side wall member 40' extends downwardly and laterally away from the generally horizontal linear member 56.

Figure 9:
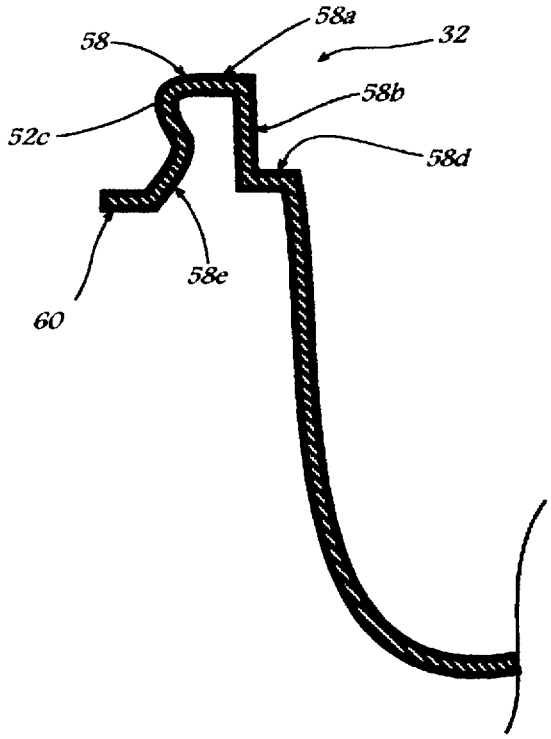
FIG. 9 is a sectional view taken generally along line 9—9 in FIG. 5.

Referring to FIG. 9, the second rim 32 includes, in cross-section, a male peripheral member 58 and a generally horizontal flange 60 projecting laterally outwardly from the male peripheral member 58. The male peripheral member 58 has a generally inverted trough-shaped configuration. Further, the male peripheral member 58 includes a generally horizontal linear member 58*a*, a first pair of members 58*b* and 58*c*, and a second pair of generally linear members 58*d* and 58*e*. The generally linear member 58*b* is generally vertical in orientation and extends downward from the generally horizontal linear member 58*a*. The linear member 58*d* is generally horizontal in orientation and projects laterally away from the linear member 58*b*. The member 58*c* extends downwardly from and laterally toward the generally horizontal linear member 58*a*. The linear member 58*e* extends downwardly and laterally away from the member 58*c* and intersects the horizontal flange 60. In combination, the members 58*a*, 58*b*, and 58*c* create a generally trapezoidal or dovetailed configuration.

Figure 10:
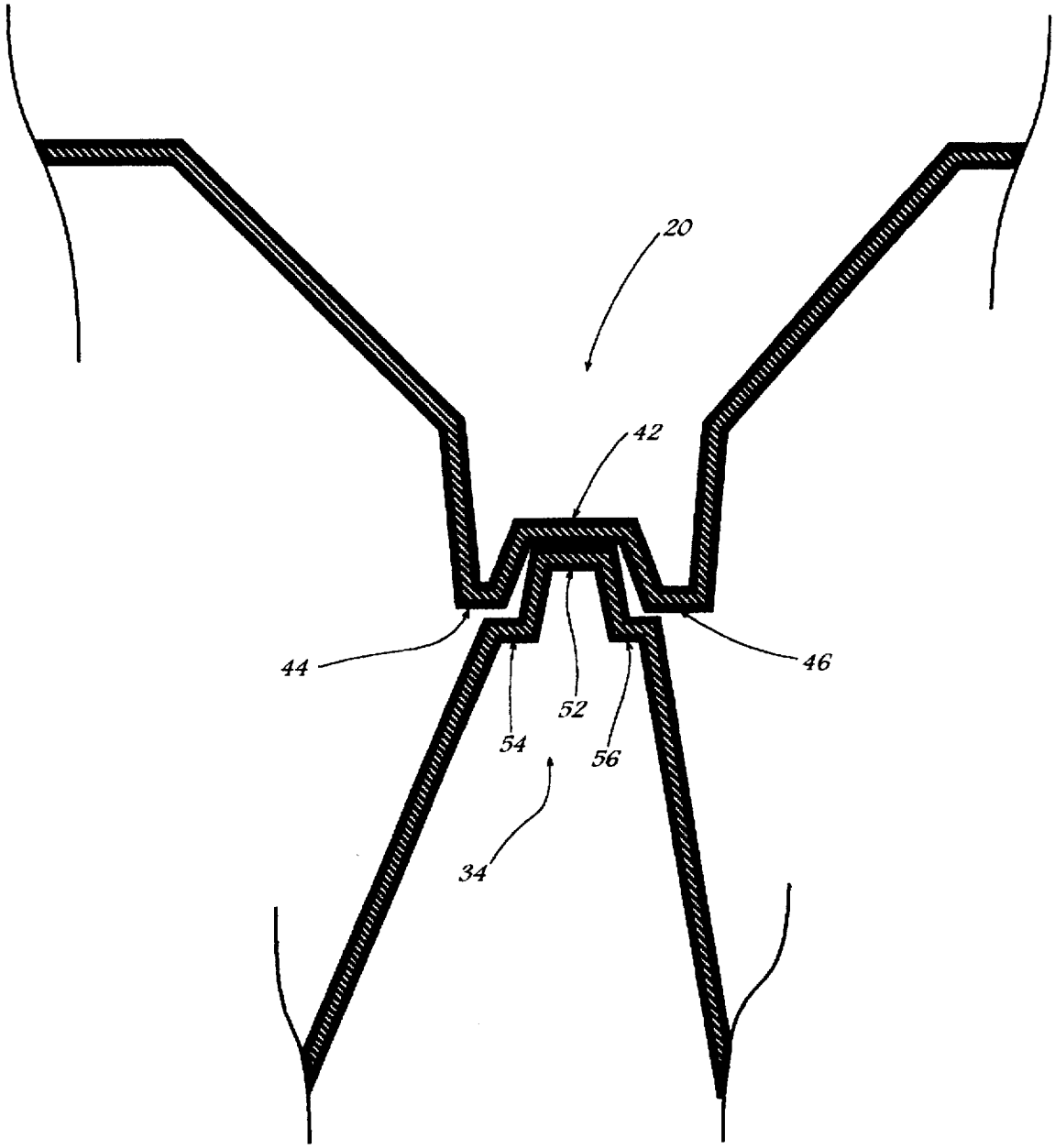
FIG. 10 is an enlarged sectional view showing engagement of the male and female partition members shown in FIGS. 8 and 6, respectively, to form an intercompartmental splash guard.
Figure 11:
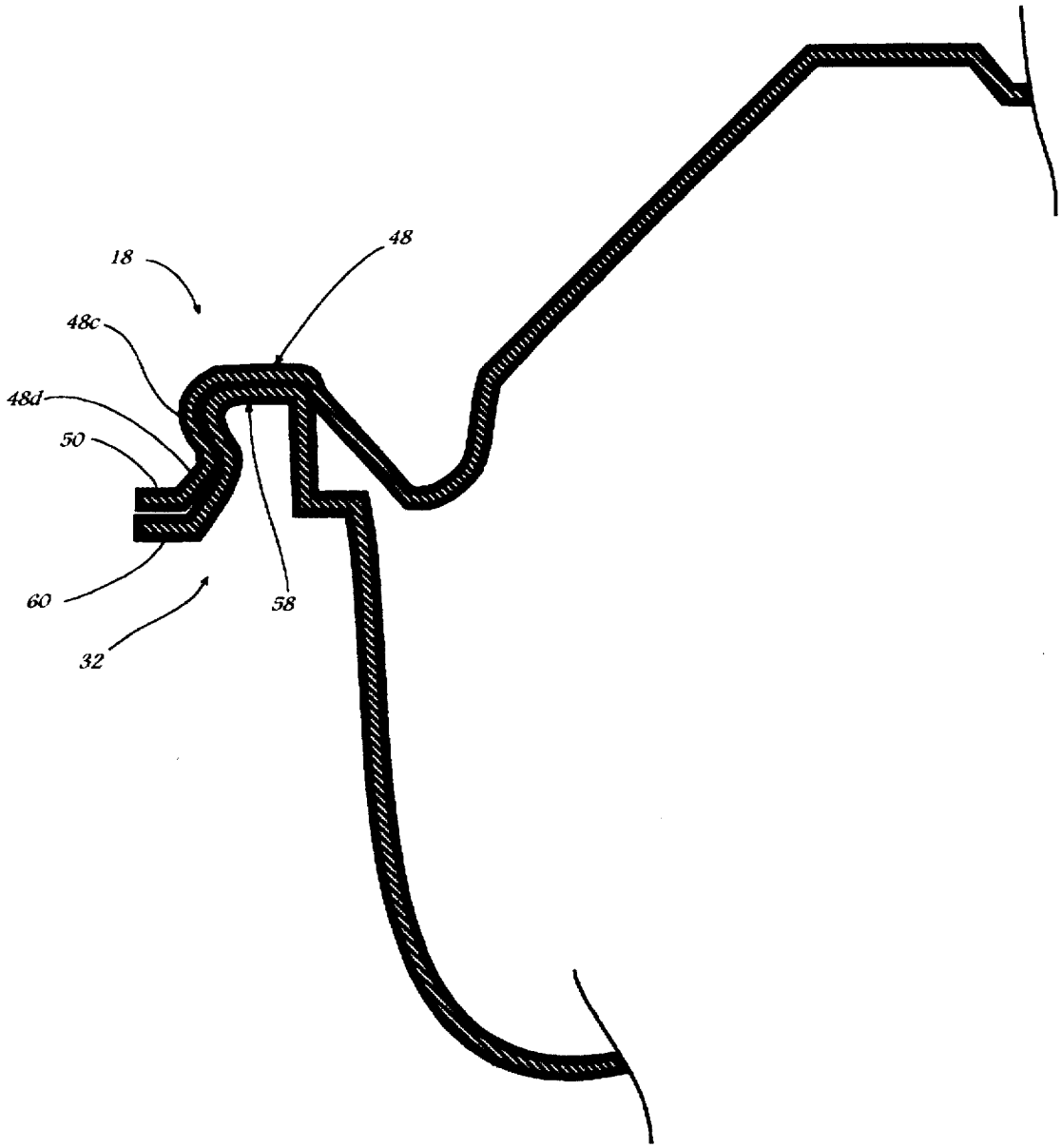
FIG. 11 is an enlarged sectional view showing engagement of the male and female peripheral members shown in FIGS. 9 and 7, respectively, to form a peripheral splash guard.

Referring to FIGS. 10 and 11, when the lid 12 is connected to the base 14, the male and female partition members 52 and 42 and the male and female peripheral members 58 and 48 minimize the passage of food juices between different compartments of the container 10 and between the container 10 and the exterior thereof.

With respect to FIG. 10, the engaged male and female partition members 52 and 42 form an intercompartmental splash guard that minimizes the passage of food juices between the base compartments 30*a* and 30*b*. The female partition member 42 snugly receives the male partition member 52. Also, the pair of small horizontal linear members 44 and 46 of the lid partition 20 are adjacent to the pair of small horizontal linear members 54 and 56 of the base partition 34. Such cooperation of the lid and base partitions 20 and 34 creates a tortuous path therebetween so as to severely limit the passage of food juices between the base compartments 30*a* and 30*b*.

With respect to FIG. 11, the latched male and female peripheral members 58 and 48 serve to both hold the lid 12 and base 14 together and form a peripheral splash guard that minimizes escape of food juices from the periphery of the container 10. The female peripheral member 58 snugly receives the male peripheral member 48. Also, the horizontal flange 50 of the first rim 18 is adjacent to the horizontal flange 60 of the second rim 32. Such cooperation of the first and second rims 18 and 32 creates a tortuous path therebetween so as to severely limit the passage of food juices between the container 10 and the exterior thereof. To engage the lid 12 with the base 14, the female peripheral member 48 of the first rim 18 is snapped over the male peripheral member 58 of the second rim 32. The plastic material of the lid 12 is sufficiently resilient to allow the members 48*c* and 48*d* of the female peripheral member 48 to temporarily flex outward during the latching operation.

The plastic food container 10 is preferably manufactured using conventional thermoforming techniques. The lid 12 is preferably composed of oriented polystyrene (OPS), polyethylene terephthalate (PET), or a combination thereof. The base 14 is preferably composed of polypropylene (PP). Those of ordinary skill in the art will recognize that other polymers or combinations of polymers may be used to thermoform the lid 12 and base 14.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A plastic food container, comprising:

a lid including a continuous first body portion and a continuous first rim encompassing and projecting laterally outwardly from said first body portion, said first body portion including at least one lid partition dividing said first body portion into at least two lid compartments, said lid partition including, in cross-section, a generally inverted trough-shaped female partition member, said first rim including, in cross-section, a generally inverted trough-shaped female peripheral member; and a base including a continuous second body portion and a continuous second rim encompassing and projecting laterally outwardly from said second body portion, said second body portion including at least one base partition dividing said second body portion into at least two base compartments, said base partition including, in cross-section, a generally inverted trough-shaped male partition member, said second rim including, in cross-section, a generally inverted trough-shaped male peripheral member, said generally inverted trough-shaped female partition member being engaged with but not latched to, said generally inverted trough-shaped male partition member.

2. The container of claim 1, wherein when said lid is connected to said base, said male and female partition members are engaged to each other to form an intercompartmental splash guard that minimizes passage of food juices between said base compartments, and said male and female peripheral members are latched to each other to hold said lid and said base together and to form a peripheral splash guard that minimizes escape of the food juices from said container to an exterior thereof.

3. A plastic food container, comprising:

a lid including a continuous first body portion and a continuous first rim encompassing and projecting laterally outwardly from said first body portion, said first body portion including at least one lid partition dividing said first body portion into at least two lid compartments, said lid partition including, in cross-section, a generally inverted trough-shaped female partition member, said first rim including, in cross-section, a generally inverted trough-shaped female peripheral member; and a base including a continuous second body portion and a continuous second rim encompassing and projecting laterally outwardly from said second body portion, said second body portion including at least one base partition dividing said second body portion into at least two base compartments, said base partition including, in cross-section, a generally inverted trough-shaped male partition member, second rim including in cross-section, a generally inverted trough-shaped male peripheral member;

wherein when said lid is connected to said base, said male and female partition members are engaged to each other to form an intercompartmental splash guard that minimizes passage of food juices between said base compartments, and said male and female peripheral members are latched to each other to hold said lid and said base together and to form a peripheral splash guard that minimizes escape of the food juices from said container to an exterior thereof; and wherein said male and female partition members each include a generally horizontal member and a pair of generally vertical members extending downward and laterally away from said horizontal member.

4. The container of claim 3, wherein said male and female partition members each include a pair of small, generally horizontal members projecting laterally away lower edges of said respective generally vertical members.

5. The container of claim 4, wherein said pair of small, generally horizontal members of said male partition are adjacent to respective ones of said pair of small, generally horizontal members of said female partition when said lid is connected to said base.

6. In a plastic food container including a lid and a base, said lid including a continuous first body portion and a continuous first rim encompassing and projecting laterally outwardly from said first body portion, said first body portion including at least one lid partition dividing said tint body portion into at least two lid compartments, said base including a continuous second body portion and a continuous second rim encompassing and projecting laterally outwardly from said second body portion, said second body portion including at least one base partition dividing said second body portion into at least two base compartments, a splash guard arrangement comprising:

an intercompartmental splash guard formed from said lid partition and said base partition, said lid partition including, in cross-section, a generally inverted trough-shaped female partition member, said base partition including, in cross-section, a generally inverted trough-shaped male partition member; and a peripheral splash guard formed from said first and second rims, said first rim including, in cross-section, a generally inverted trough-shaped female peripheral member, said second rim including, in cross-section, a generally inverted trough-shaped male peripheral member, said generally inverted trough-shaped female partition member being engaged with, but not latched to, said generally inverted trough-shaped male partition member.

7. The arrangement of claim 6, wherein when said lid is connected to said base, said male and female partition members are engaged to each other, and said male and female peripheral members are latched to each other to hold said lid and said base together.

8. In a plastic food container including a lid and a base, said lid including a continuous first body portion and a continuous first rim encompassing and projecting laterally outwardly from said first body portion, said first body portion including at least one lid partition dividing said tint body portion into at least two lid compartments, said base including a continuous second body portion and a continuous second rim encompassing and projecting laterally outwardly from said second body portion, said second body portion including at least one base partition dividing said second body portion into at least two base compartments, a splash guard arrangement comprising:

an intercompartmental splash guard formed from said lid partition and said base partition, said lid partition including, in cross-section, a generally inverted trough-shaped female partition member, said base partition including, in cross-section, a generally inverted trough-shaped male partition member, and a peripheral splash guard formed from said first and second rims, said first rim including, in cross-section, a generally inverted trough-shaped female peripheral member, said second rim including, in cross-section, a generally inverted trough-shaped male peripheral member;

wherein when said lid is connected to said base, said male and female partition members are engaged to each other, and said male and female peripheral members are latched to each other to hold said lid and said base together; and wherein said male and female partition members each include a generally horizontal member and a pair of generally vertical members extending downward and laterally away from said horizontal member.

9. The container of claim 8, wherein said male and female partition members each include a pair of small, generally horizontal members projecting laterally away lower edges of said respective generally vertical members.

10. The container of claim 9, wherein said pair of small, generally horizontal members of said male partition are adjacent to respective ones of said pair of small, generally horizontal members of said female partition when said lid is connected to said base.

11. A plastic food container, comprising:

a lid including a continuous first body portion and a continuous first rim encompassing and projecting laterally outwardly from said first body portion, said first body portion including at least one lid partition dividing said first body portion into at least two lid compartments, said lid partition including, in cross-section, a generally inverted trough-shaped female partition member, said first rim including, in cross-section, a generally inverted trough-shaped female peripheral member; and a base including a continuous second body portion and a continuous second rim encompassing and projecting laterally outwardly from said second body portion, said second body portion including at least one base partition dividing said second body portion into at least two base compartments, said base partition including, in cross-section, a generally inverted trough-shaped male partition member, said second rim including, in cross-section, a generally inverted trough-shaped male peripheral member, said generally inverted trough-shaped female partition member not intersecting with said generally inverted trough-shaped female peripheral member and said generally inverted trough-shaped male partition member not intersecting with said generally inverted trough-shaped male peripheral member.

* * * * *